US011220880B2

(12) United States Patent
Andersen

(10) Patent No.: US 11,220,880 B2
(45) Date of Patent: Jan. 11, 2022

(54) ANNULAR BARRIER WITH BITE CONNECTION

(71) Applicant: WELLTEC OILFIELD SOLUTIONS AG, Zug (CH)

(72) Inventor: Tomas Sune Andersen, Zug (CH)

(73) Assignee: WELLTEC OILFIELD SOLUTIONS AG, Zug (CH)

( * ) Notice: Subject to any disclaimer, the term of this patent is extended or adjusted under 35 U.S.C. 154(b) by 0 days.

(21) Appl. No.: 16/906,342

(22) Filed: Jun. 19, 2020

(65) Prior Publication Data

US 2020/0399977 A1 Dec. 24, 2020

(30) Foreign Application Priority Data

Jun. 21, 2019 (EP) ..... 19181732

(51) Int. Cl.
*E21B 33/127* (2006.01)

(52) U.S. Cl.
CPC ..... *E21B 33/1277* (2013.01)

(58) Field of Classification Search
CPC ..... E21B 33/1277; E21B 33/127; E21B 33/12
See application file for complete search history.

(56) References Cited

U.S. PATENT DOCUMENTS 3,003,798 A * 10/1961 Sandlin ..... E21B 33/1208 403/270
4,082,298 A * 4/1978 Sanford ..... E21B 33/127 166/187
4,244,590 A * 1/1981 Sanford ..... E21B 33/1277 277/333
4,892,144 A * 1/1990 Coone ..... E21B 33/1277 166/122
6,431,274 B1 8/2002 Nowlin et al.
9,447,653 B1 9/2016 Abi Aad

OTHER PUBLICATIONS

Extended Search Report for EP19181732 dated Dec. 13, 2019, 7 pages.

* cited by examiner

*Primary Examiner* — Caroline N Butcher
(74) *Attorney, Agent, or Firm* — Nixon & Vanderhye P.C.

(57) ABSTRACT

An annular barrier includes a metal part and an expandable metal sleeve. The first end of the sleeve has a mechanical connection, and is connected to the metal part via a bite connection with a cutting ring including an outer ring face having an inclined face and an inner ring face having a first cutting edge configured to cut into the outer part face, and a connection ring with a mechanical connection engaging the mechanical connection of the sleeve when the inclined face slides along a tapering face of the sleeve for pressing the first cutting edge into the outer part face, fastening the sleeve to the tubular metal part.

18 Claims, 10 Drawing Sheets

ANNULAR BARRIER WITH BITE CONNECTION

Figure 1:
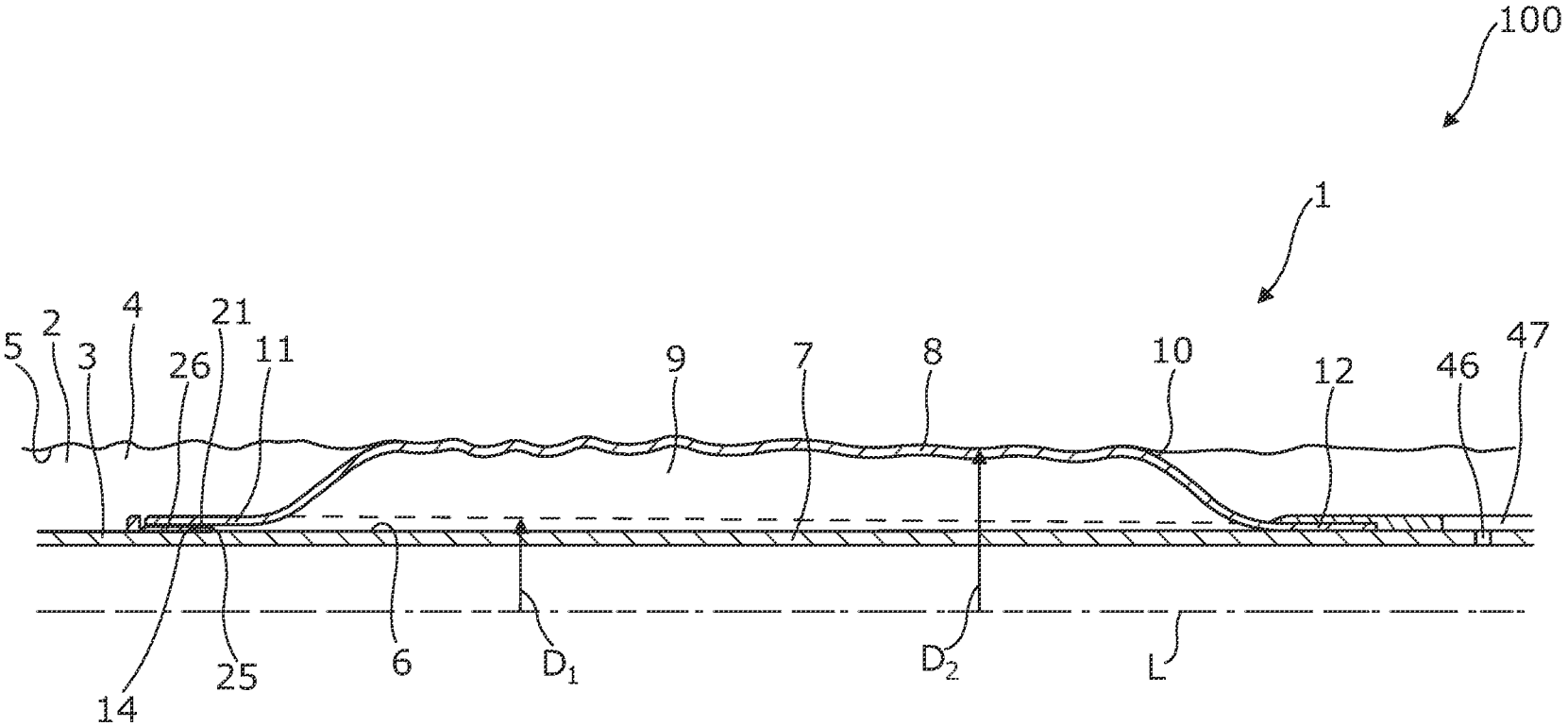

This application claims priority to EP Patent Application No. 19181732.9 filed 21 Jun. 2019, the entire contents of which is hereby incorporated by reference.

The present invention relates to an annular barrier for providing zonal isolation in an annulus downhole between a well tubular metal structure and another well tubular metal structure or a wall of a borehole. The invention also relates to a downhole system comprising at least one annular barrier and a well tubular metal structure of which the tubular metal part forms a part.

Annular barriers are mounted as part of a cased well with the aim of isolating a production zone from zones which are producing excessive water. Some of these barriers have an expandable metal sleeve which is fastened to the well tubular metal structure by means of welding or crimping. However, sometimes such fastening is not successful, for example in wells having a significantly varying hole diameter, such as wash outs, where the expandable metal sleeve may have to be expanded to a larger extent than the extent that such connections are able to withstand without jeopardising the sealing ability.

Furthermore, fastening the expandable metal sleeve by means of welding or crimping is time consuming and laborious, and is extremely difficult to perform on site.

It is an object of the present invention to wholly or partly overcome the above disadvantages and drawbacks of the prior art. More specifically, it is an object to provide an improved annular barrier which is easier to mount to the well tubular metal structure and/or which is capable of withstanding high expansion without jeopardising the sealing ability especially with regard to the connection of the expandable metal sleeve to the well tubular metal structure.

The above objects, together with numerous other objects, advantages and features, which will become evident from the below description, are accomplished by a solution in accordance with the present invention by an annular barrier for providing zonal isolation in an annulus downhole between a well tubular metal structure and another well tubular metal structure or a wall of a borehole, comprising:

- a tubular metal part with an outer part face, configured to be mounted as part of the well tubular metal structure,
- an expandable metal sleeve surrounding the tubular metal part forming an expandable space there between the expandable metal sleeve is configured to be expanded in a well downhole from a first outer diameter to a second outer diameter to abut against the well tubular metal structure or the wall of the borehole, the expandable metal sleeve having a first end, a second end, an outer face, and a longitudinal extension wherein the first end of the expandable metal sleeve has a first part of a mechanical connection, and wherein the first end of the expandable metal sleeve is connected to the tubular metal part by means of a bite connection comprising:

- a cutting ring comprising an outer ring face having an inclined face and an inner ring face, having a first cutting edge configured to cut into the outer part face, and
- a connection ring with a second part of the mechanical connection engaging the first part of the mechanical connection of the expandable metal sleeve when the inclined face slides along a tapering face of the expandable metal sleeve for pressing the first cutting edge into the outer part face fastening the expandable metal sleeve to the tubular metal part.

Additionally, the first part of the mechanical connection of the expandable metal sleeve may be a thread, and the second part of the mechanical connection of the connection ring may be a thread engaging the thread of the expandable metal sleeve.

Moreover, the thread of the expandable metal sleeve may be an internal thread, and the thread of the connection ring may be an external thread, or the thread of the expandable metal sleeve may be an external thread, and the thread of the connection ring may be an internal thread.

Furthermore, the cutting ring may comprise a second cutting edge configured to cut into the outer part face.

Additionally, the first part of the mechanical connection of the expandable metal sleeve may be an indentation, and the second part of the mechanical connection of the connection ring may be a projectable element engaging the indentation of the expandable metal sleeve forming the mechanical connection.

In addition, the cutting ring may have a second inclined face abutting a second tapering face of the connection ring.

Also, the inclined face of the cutting ring may face the internal thread.

Furthermore, the bite connection may further comprise a ferrule arranged between the cutting ring and the expandable metal sleeve or the connection ring.

In addition, the tapering face along which the inclined face of the cutting ring slides instead of being arranged on the expandable metal sleeve may be arranged on the ferrule.

Additionally, the bite connection may further comprise at least one sealing element for sealing between the expandable metal sleeve and the tubular metal part.

Moreover, the connection ring may have a first end abutting the cutting ring and a second end having an engagement element for engagement with a mounting tool in order to rotate the connection ring moving axially to force the cutting ring into engagement with the tubular metal part.

Also, the engagement element may be a nut-shaped end.

In addition, the expandable metal sleeve may be several sleeve parts welded or moulded together.

Furthermore, the first part of the mechanical connection of the expandable metal sleeve may be arranged at a distance to the outer part face, forming an annular cavity in which the cutting ring and part of the connection ring are arranged.

Additionally, the second part of the mechanical connection of the connection ring may be arranged at a distance to the outer part face forming an annular cavity in which the cutting ring and part of the connection ring are arranged.

Moreover, the thread of the connection ring may be arranged at a distance to the outer part face forming an annular cavity in which the cutting ring and part of the expandable metal sleeve are arranged.

In addition, each end of the expandable metal sleeve may be connected to the tubular metal part by means of the bite connection.

Furthermore, the cutting ring may have a first end part facing the connection ring and a second end part facing the expandable metal sleeve, the second end part having a decreased thickness in relation to the first end part.

Also, the connection ring and the cutting ring may be made of metal.

Additionally, the ferrule may be partly covered with a sealing material, such as elastomer.

Furthermore, the tubular metal part may have an expansion opening for letting fluid into the space for expanding the expandable metal sleeve.

Moreover, the annular barrier may further comprise a valve block in fluid communication with the expansion opening for controlling the flow of fluid into the space.

Finally, the present invention relates to a downhole system comprising at least one annular barrier and a well tubular metal structure of which the tubular metal part forms part.

Figure 2:
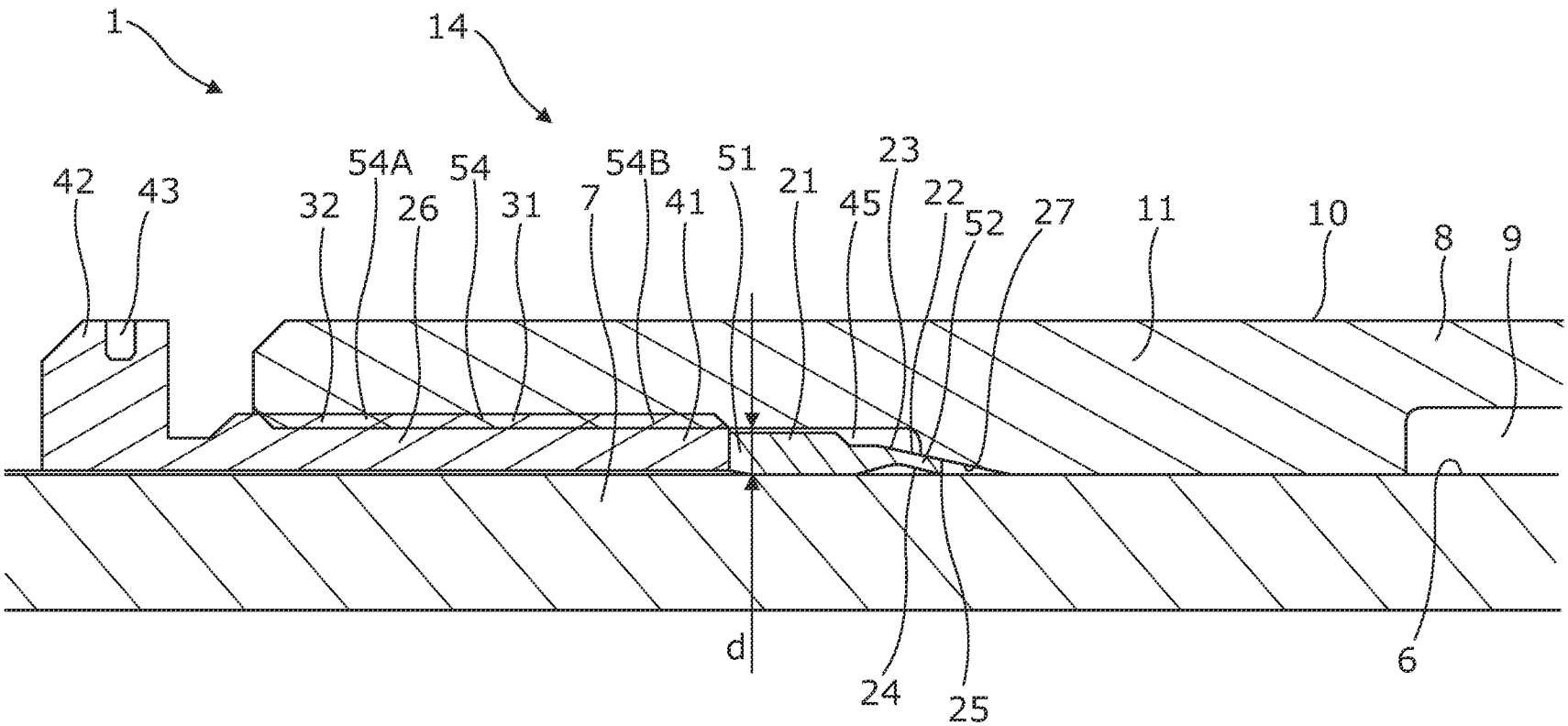
Figure 3A:
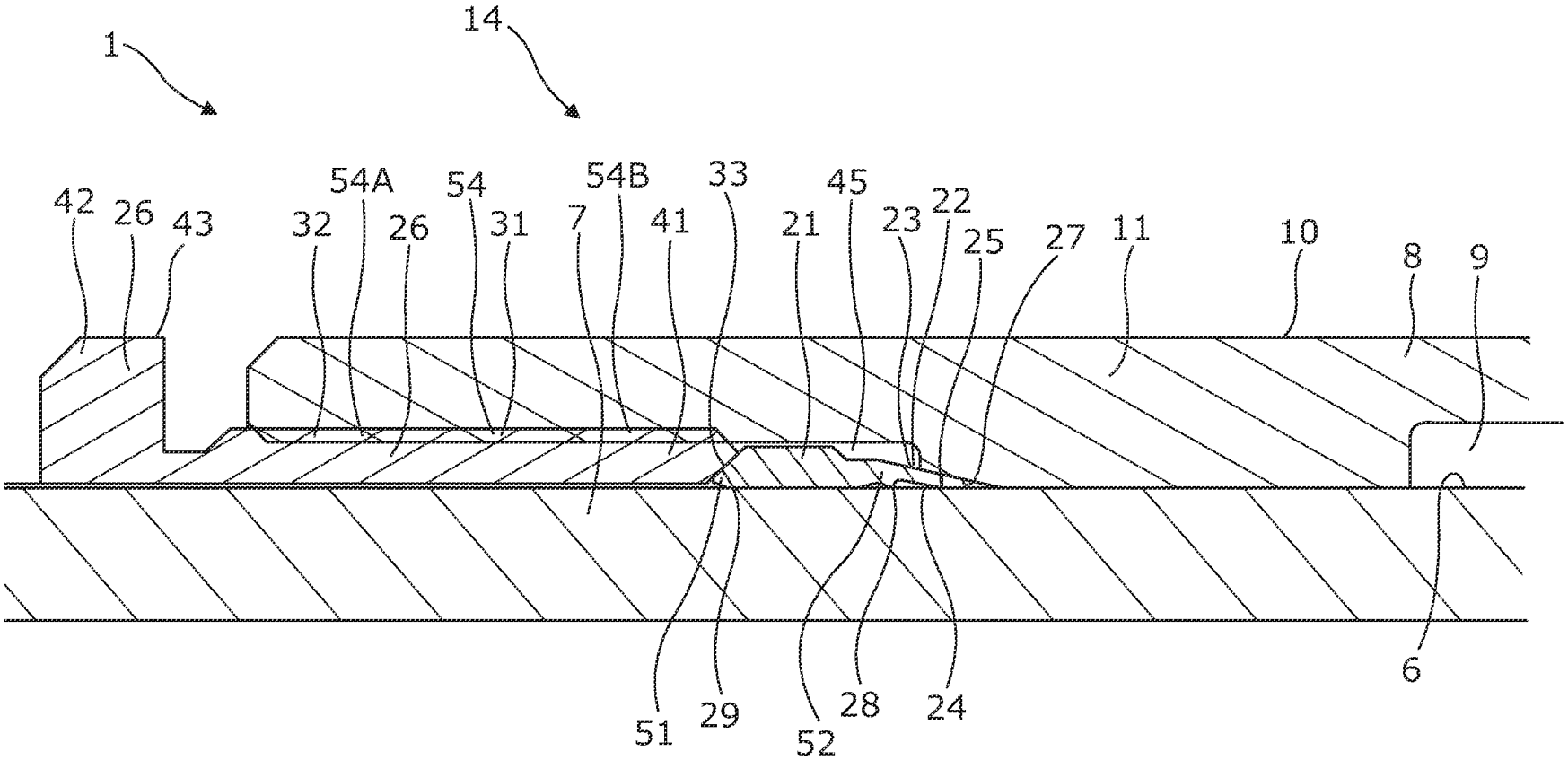
Figure 3B:
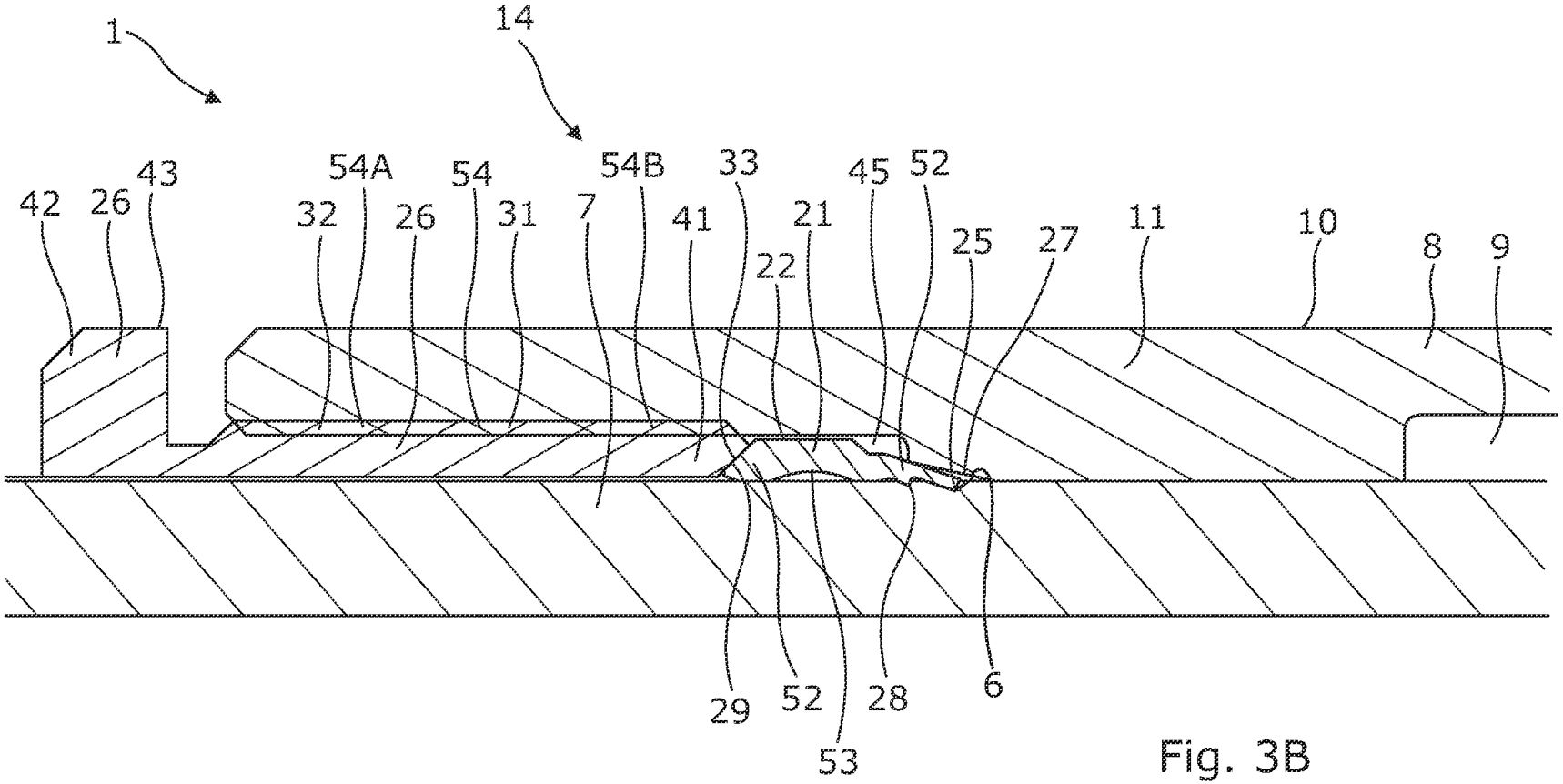
Figure 4A:
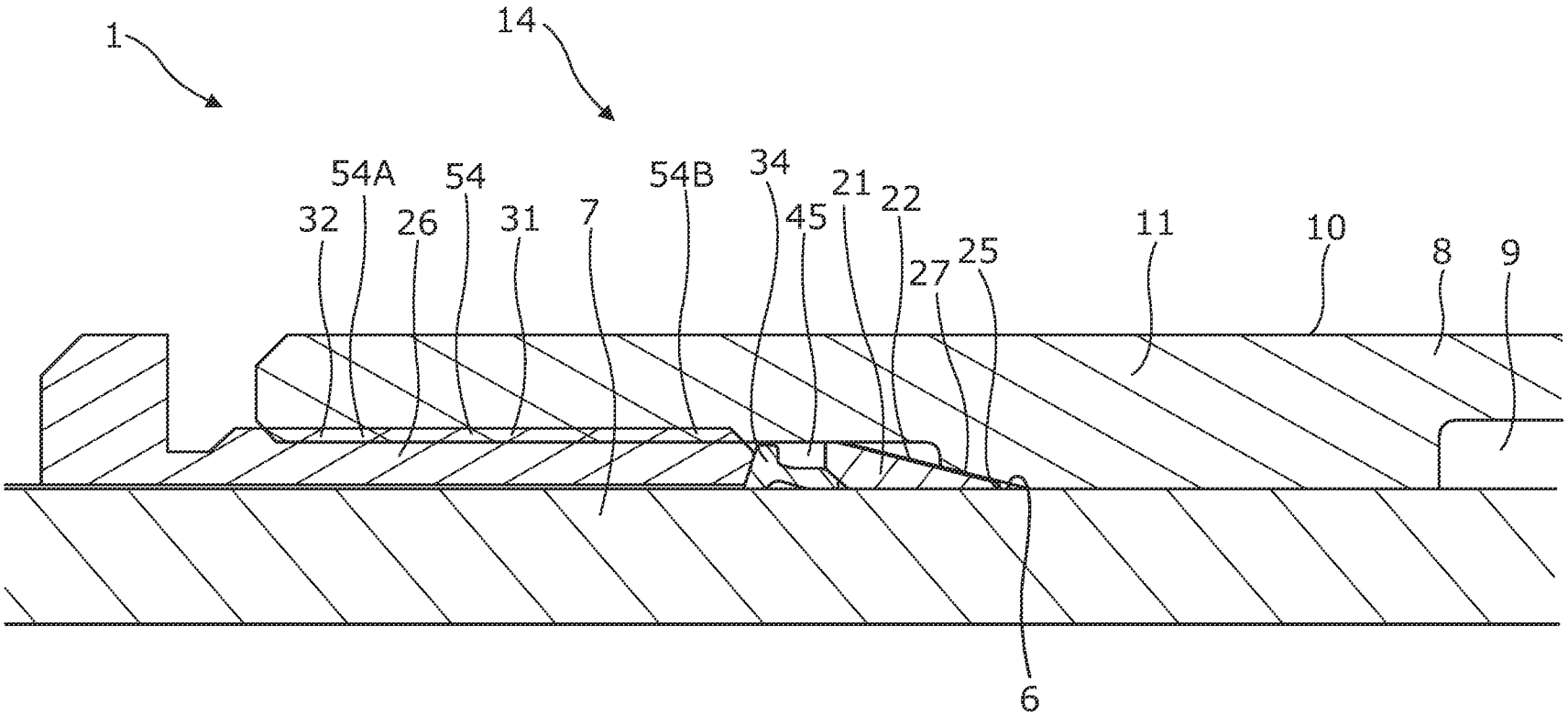
Figure 4B:
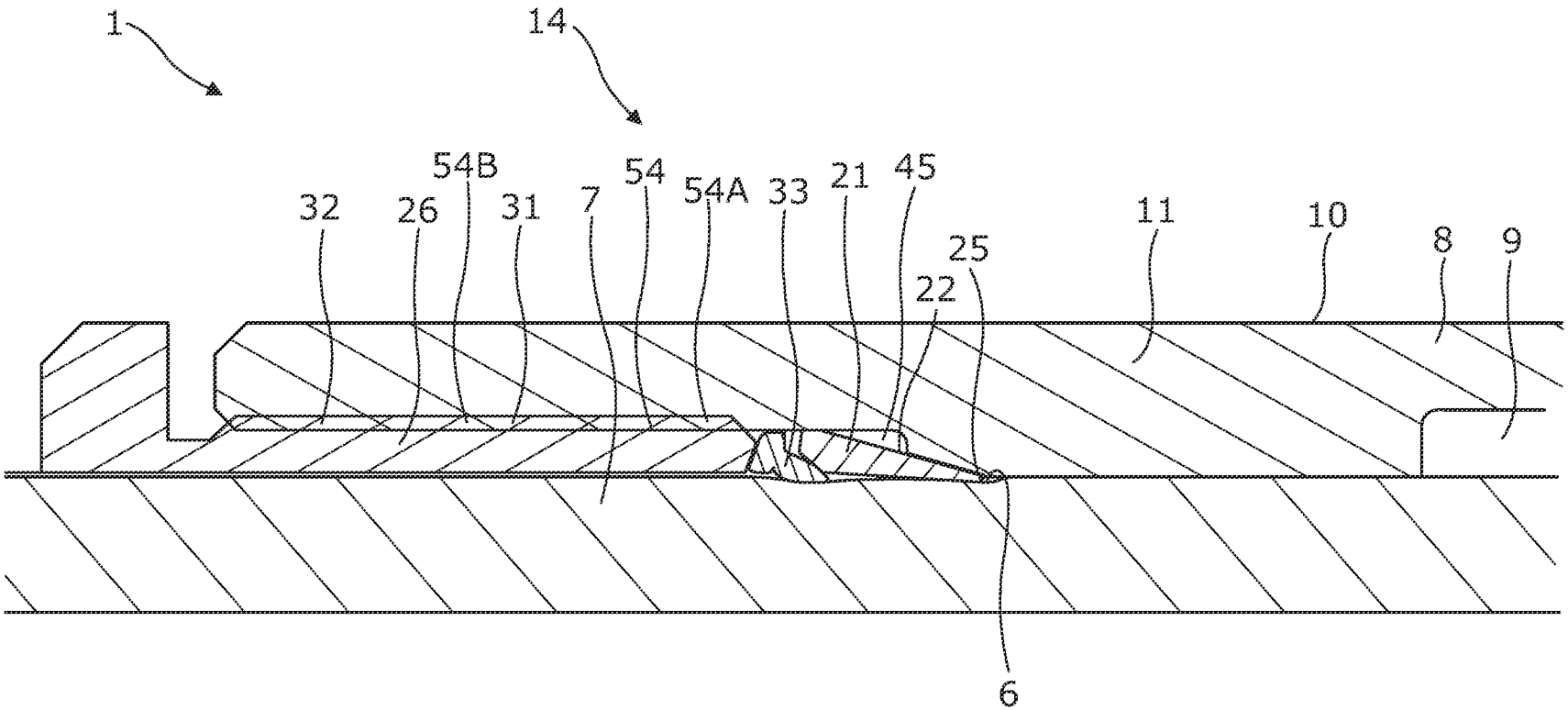
Figure 5:
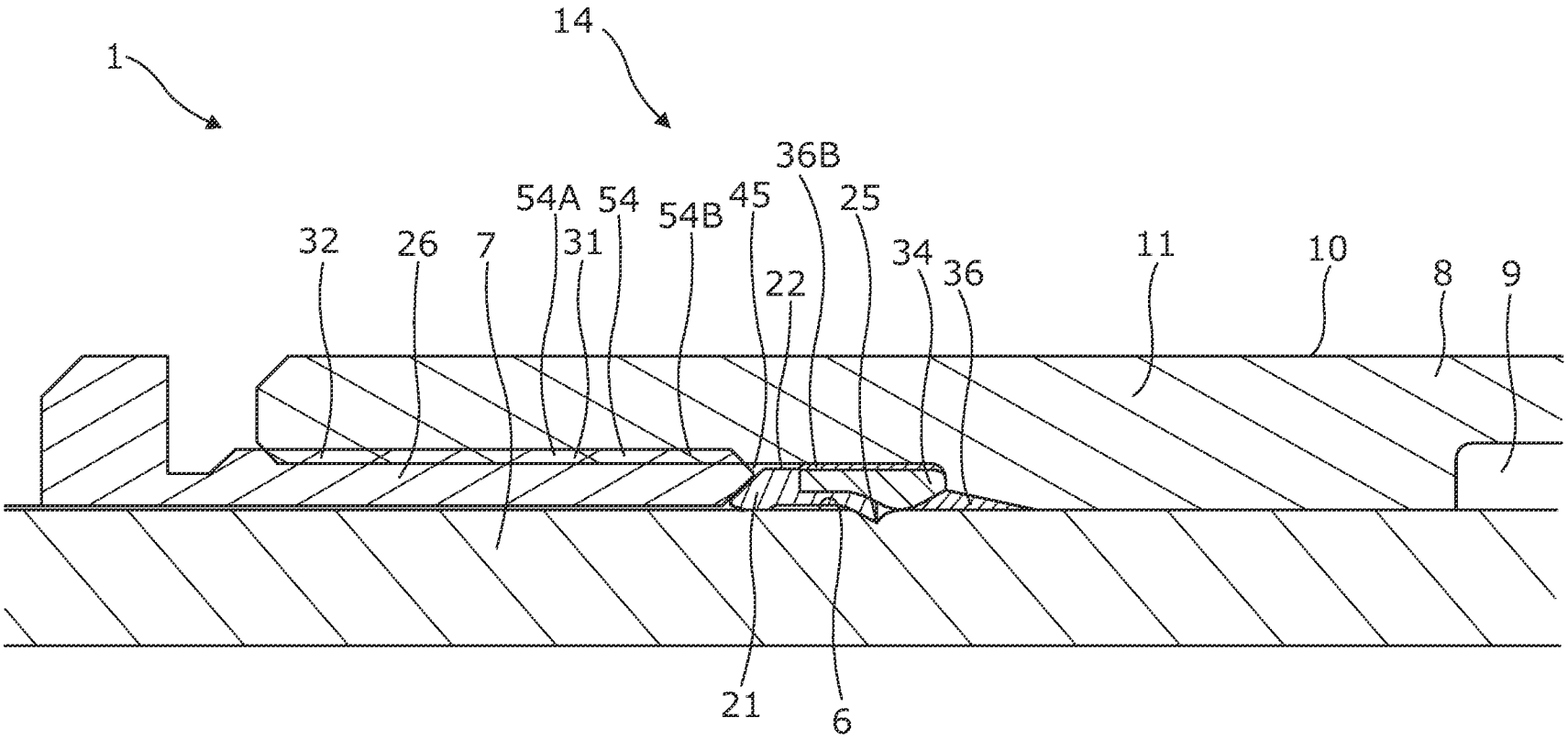
Figure 6:
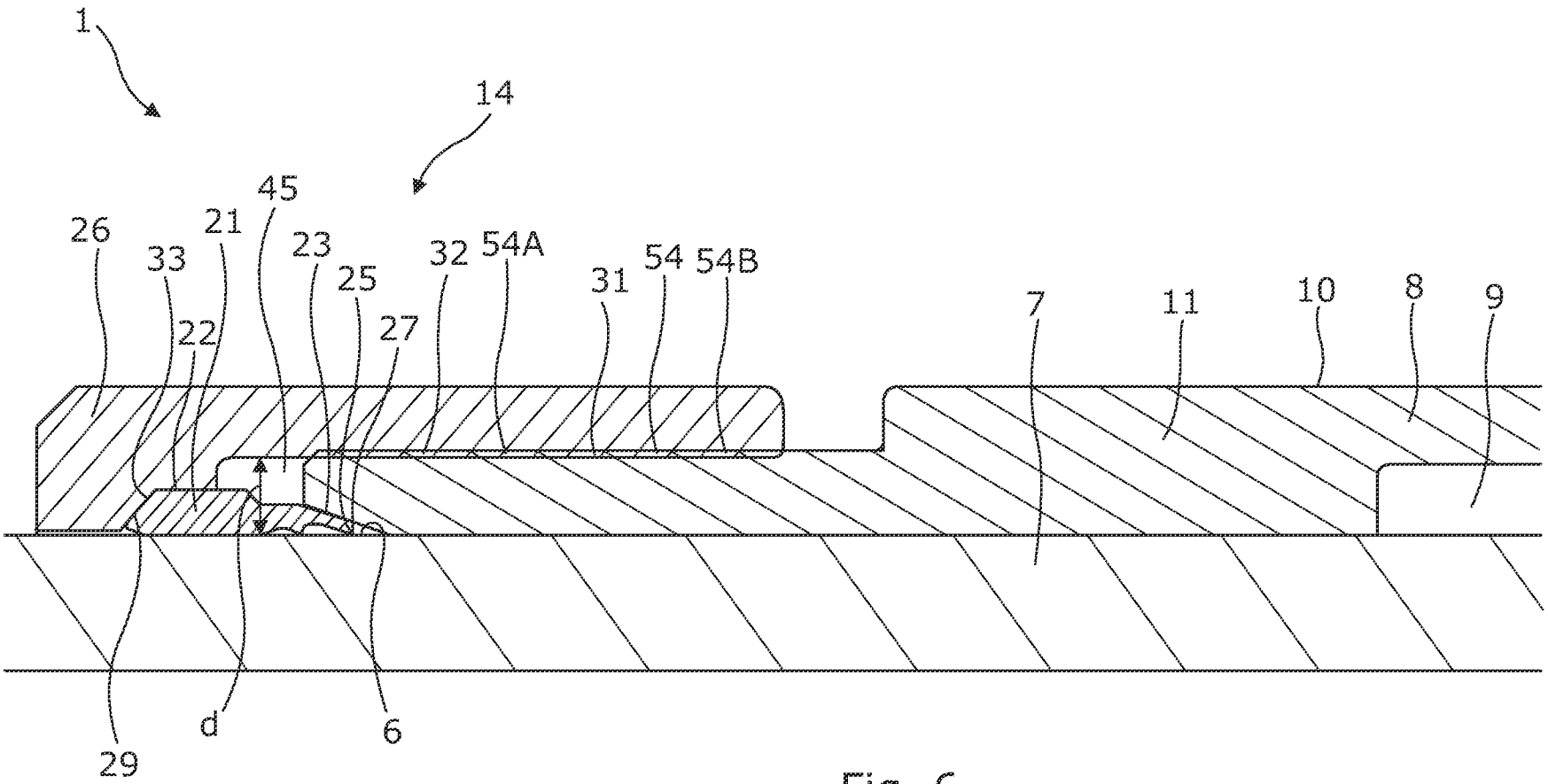
Figure 7A:
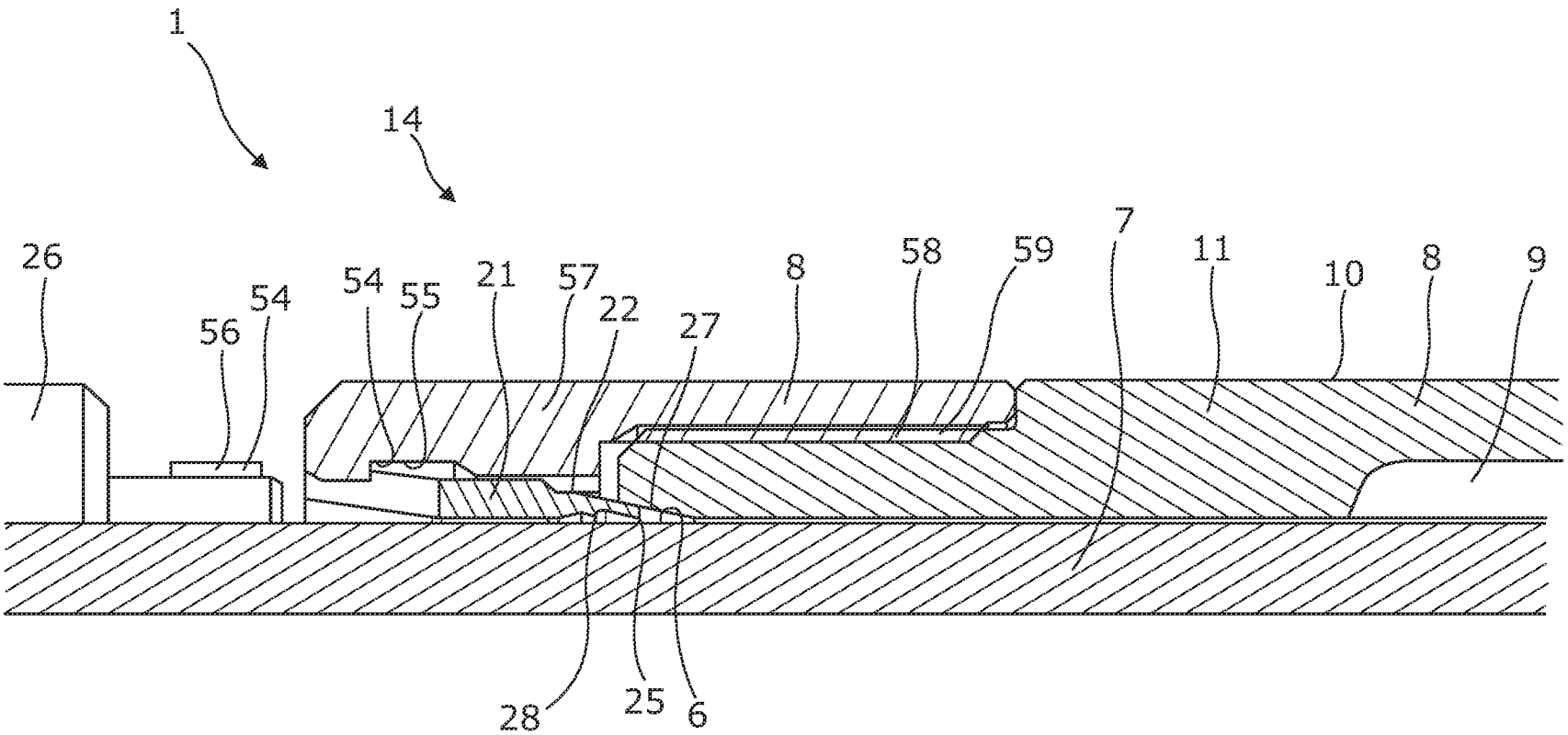
Figure 7B:
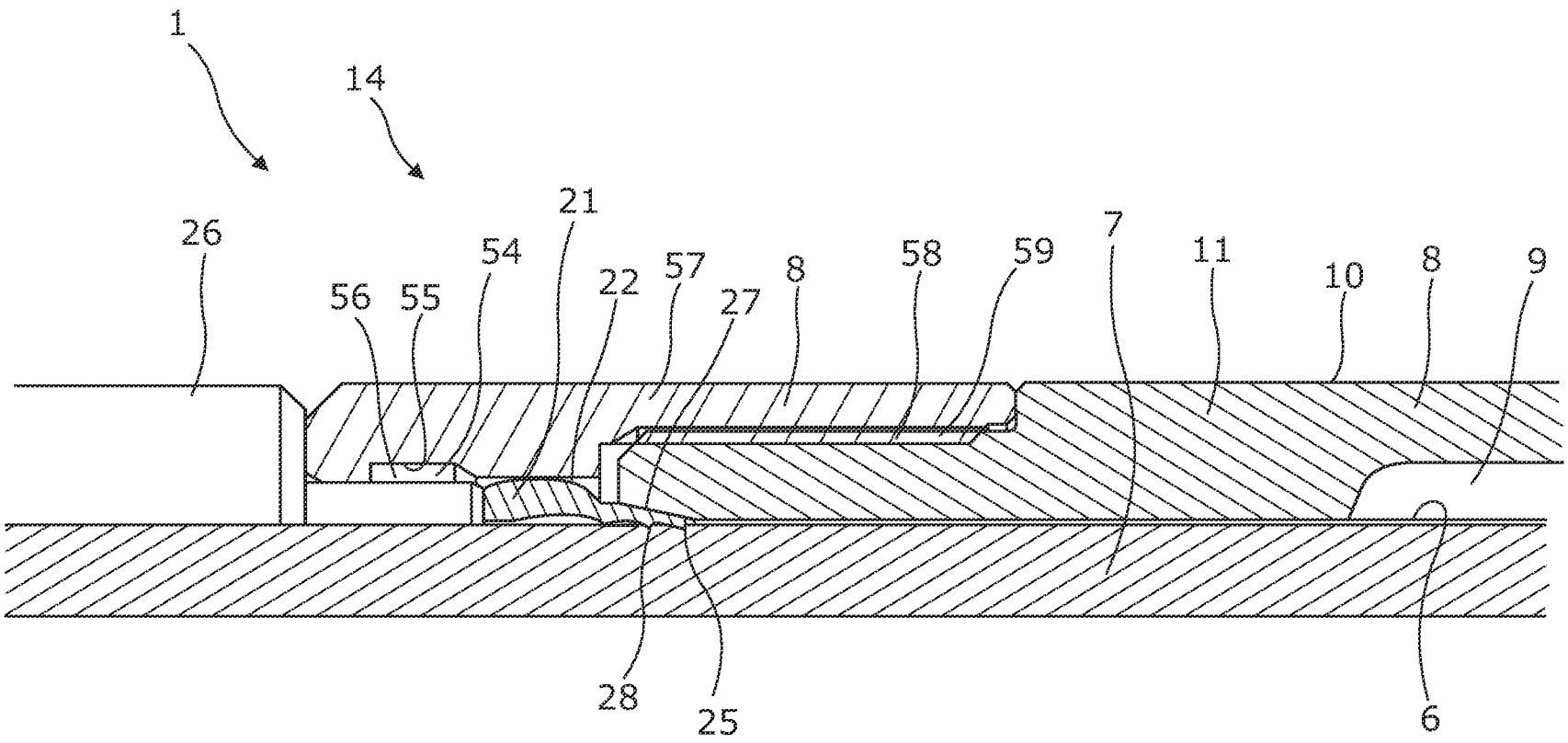

The invention and its many advantages will be described in more detail below with reference to the accompanying schematic drawings, which for the purpose of illustration show some non-limiting embodiments and in which:

FIG. 1 shows a cross-sectional view of an annular barrier having a bite connection in one end of the expandable metal sleeve, FIG. 2 shows an enlarged cross-sectional view of a bite connection of an annular barrier, FIG. 3A shows an enlarged cross-sectional view of another bite connection in its unconnected position, FIG. 3B shows an enlarged cross-sectional view of the bite connection of FIG. 3A in its connected position where the expandable metal sleeve is fastened to the well tubular metal structure, FIG. 4A shows an enlarged cross-sectional view of another bite connection having a ferrule, FIG. 4B shows an enlarged cross-sectional view of the bite connection of FIG. 4A in its connected position, FIG. 5 shows an enlarged cross-sectional view of yet another bite connection in its connected position, FIG. 6 shows an enlarged cross-sectional view of another bite connection in its unconnected position, FIG. 7A shows an enlarged cross-sectional view of yet another bite connection in its unconnected position, and FIG. 7B shows an enlarged cross-sectional view of the bite connection of FIG. 7A in its connected position.

All the figures are highly schematic and not necessarily to scale, and show only those parts which are necessary in order to elucidate the invention, other parts being omitted and/or merely suggested.

FIG. 1 shows an annular barrier 1 for providing zonal isolation in an annulus 2 downhole between a well tubular metal structure 3 and another well tubular metal structure or a wall 5 of a borehole 4. The annular barrier comprises a tubular metal part 7 which is mounted as part of the well tubular metal structure of a completion in an oil or gas well. The tubular metal part 7 has an outer part face 6 forming part of the outer face of the well tubular metal structure of the at least partly cased well. The annular barrier comprises an expandable metal sleeve 8 surrounding the tubular metal part forming an expandable space 9 between the expandable metal sleeve and the tubular metal part. The expandable metal sleeve 8 is configured to be expanded in a well downhole from a first outer diameter $D_1$ to a second outer diameter $D_2$ to abut against the well tubular metal structure 3 or the wall of the borehole as shown in FIG. 1. The expandable metal sleeve 8 has a first end 11, a second end 12, an outer face 10, and a longitudinal extension L. As shown in FIG. 2, the first end of the expandable metal sleeve has a first part 54A of a mechanical connection 54 being a thread 31. The first end of the expandable metal sleeve is connected to the tubular metal part by means of a bite connection 14. The bite connection 14 comprises a cutting ring 21 comprising an outer ring face 22 having an inclined face 23, and an inner ring face 24 having a first cutting edge 25 configured to cut into the outer part face of the tubular metal part. The bite connection 14 further comprises a connection ring 26 with a second part 54B of the mechanical connection 54 being a thread 32 engaging the thread of the expandable metal sleeve so that when rotating the connection ring the inclined face 23 slides along a tapering face 27 of the expandable metal sleeve pressing the first cutting edge into the outer part face, fastening the expandable metal sleeve 8 to the tubular metal part 7.

By forcing the cutting ring into the outer part face of the tubular metal part, the expandable metal sleeve is fastened to the tubular metal part in a simple manner which does not alter the material properties as seen in prior art in relation to welding or crimping. Furthermore, the fastening is easier to reproduce than welding. A bite connection is, moreover, substantially cheaper to use for mounting of the expandable metal sleeve to the tubular metal part as this solution is less time consuming than welding. The bite connection fastens the expandable metal sleeve to the tubular metal part using the threaded connection to the expandable metal sleeve and rotating the connection ring so that the bite, i.e. the cutting ring 21, is forced to press and/or cut into the outer part face of the tubular metal part.

The bite connection provides a very simple way of mounting the expandable metal sleeve to the tubular metal part, and the connection may be performed onsite, that is on the rig or platform.

The cutting edge of the cutting ring 21 is forced into the tubular metal part 7 and thus provides a metal-to-metal seal between the tubular metal part and the expandable metal sleeve by means of the threaded connection between the connection ring and the expandable metal sleeve. Thus, there is no need for a sealing element, and the bite connection provides an annular barrier which is able to withstand high temperatures. Moreover, the bite connection can also withstand a higher radial expansion than for example a welded connection.

The thread of the expandable metal sleeve may be an internal thread as shown in FIGS. 1-5 or an external thread as shown in FIG. 6. In FIGS. 1-5, the thread of the expandable metal sleeve is an internal thread engaging the thread of the connection ring which is an external thread thereby providing a mechanical connection 54.

In FIGS. 7A and 7B, the first part of the mechanical connection 54 of the expandable metal sleeve 8 is an indentation 55, and the second part of the mechanical connection 54 of the connection ring 26 is a projectable element 56 engaging the indentation 55 of the expandable metal sleeve. In FIG. 7A, the bite connection 14 is in its inactivated condition where the cutting edge 25 is not engaging the tubular metal part 7, and in FIG. 7B the cutting edge 25 is engaging the outer part face 6 of the tubular metal part. The connection ring 26 is pushed axially along the axial extension L (shown in FIG. 1) of the annular barrier 1 pushing the cutting ring 21 axially so that the inclined face of the cutting edge 25 slides along the tapering face of the expandable metal sleeve 8 until the projectable element 56 is opposite the indentation 55 in which it projects fastening the connection ring 26 in relation to the expandable metal sleeve 8. The expandable metal sleeve 8 has an end part 57 fastened to the rest of the expandable metal sleeve 8 by means of the engaging threads 58, 59. The connection ring may by pushed into engagement with the expandable metal sleeve by means of hydraulics or similar means.

Thus, the mechanical connection 54 of the expandable metal sleeve is a first part 54A of the mechanical connection between the expandable metal sleeve and the connection ring 26, and the mechanical connection 54 of the connection ring is a second part 54B of the mechanical connection 54.

In FIG. 2, the cutting ring 21 has a first end part 51 facing the connection ring 26 and a second end part 52 facing the expandable metal sleeve. The second end part 52 has a decreased thickness in relation to the first end part 51. The cutting ring 21 comprises the first cutting edge for cutting into the outer part face of the tubular metal part as the tapering face 27 of the expandable metal sleeve presses the second end part 52 of the cutting ring 21 radially inwards as the connection ring is rotated. The connection ring 26 has a first end 41 abutting the first end part 51 of the cutting ring 21 and a second end 42 having an engagement element 43 for engagement with a mounting tool in order to rotate the connection ring, which thereby axially moves to force the cutting edge 25 of the cutting ring into engagement with the tubular metal part. The engagement element 43 is a bore for engagement with a male of a mounting tool (not shown). In FIG. 3A, the engagement element is a nut-shaped end of the second end so that a mounting tool can engage around the nut-shaped end.

In FIG. 2, the first end of the expandable metal sleeve has a greater thickness than the intermediate part 61 of the expandable metal sleeve which is the part between the first end and the second end of the expandable metal sleeve. Even though not shown, each end of the expandable metal sleeve is connected to the tubular metal part by means of the bite connection. The second end of the expandable metal sleeve is therefore fastened in the same way as the first end, namely by means of a bite connection 14. The cutting ring 21 is arranged in an annular cavity 45 formed between the first end 11 of the expandable metal sleeve 8 and the outer part face 6 and is closed by the first end 41 of the connection ring 26. Thus, the thread of the expandable metal sleeve is arranged at a distance d to the outer part face forming the annular cavity 45 in which the cutting ring and part of the connection ring are arranged. However in another solution, the first end of the expandable metal sleeve may be fastened by means of a bite connection and the second end of the expandable metal sleeve may be fastened in another way or be made as a sliding end, that is sliding in relation to the tubular metal part.

In FIGS. 3A and 3B, the cutting ring 21 comprises both a first cutting edge 25 and a second cutting edge 28 configured to cut into the outer part face, and the cutting ring has a second inclined face 29 abutting a second tapering face 33 of the connection ring 26. The inclined face 23 of the cutting ring 21 faces the internal thread of the expandable metal sleeve 8. In FIG. 3A, the bite connection 14 has not been activated, and the expandable metal sleeve 8 has not been fastened to the tubular metal part 7. In FIG. 3B, the bite connection 14 is activated, and the connection ring 21 has been rotated to engage the cutting edges 25, 28 in the outer part face. When the connection ring is rotated and moves, the second tapering face 33 presses on the second inclined face 29 so that the cutting ring 21 bends forming a curvature 53 so that the cutting edges 25, 28 experience a more radial force than if there were no curvature easing the cutting of the cutting edges into the tubular metal part. By having the second tapering face 33 pressing on the second inclined face 29, a spring force is provided in the cutting ring 21 enhancing the fastening provided by the bite connection 14. When the expandable metal sleeve 8 is exposed to high radial expansion, the spring force will push and maintain the cutting edge into engagement with the tubular metal part. The inherent force of the spring force is thus somewhat released during expansion as more space in the cavity 45 is allowed due to the act of expansion pulling in the ends of the expandable metal sleeve.

In FIGS. 4A and 4B, the bite connection 14 further comprises a ferrule 34 arranged between the cutting ring 21 and the connection ring 26. In FIG. 4A, the bite connection 14 is in its inactivated state, and in FIG. 4B, the bite connection 14 has been activated and fastens the expandable metal sleeve 8 to the tubular metal part 7. The connection ring 26 has been moved from FIG. 4A to FIG. 4B, and the ferrule 34 has been compressed and has moved the cutting ring 21 into engagement with the outer part face 6 of the tubular metal part, as the cutting ring has been squeezed in between the expandable metal sleeve and the tubular metal part, and the cutting edge 25 cuts into the outer part face 6 as shown in FIG. 4B.

In FIG. 5, the bite connection 14 further comprises a ferrule 34 arranged between the cutting ring 21 and the expandable metal sleeve 8. In order to provide a better seal there between, the bite connection further comprises a sealing element 36, 36B for sealing between the expandable metal sleeve 8 and the tubular metal part 7. In FIG. 5, the bite connection has been activated, and the cutting edge 25 of the cutting ring 21 engages the outer part face 6. During activation, where the cutting edge 25 of the cutting ring 21 is pressed into the tubular metal part, the cutting ring moves and thereby moves the ferrule 34 whereby the sealing element is pressed into the cavity between the tubular metal part and the expandable metal sleeve, thus providing a better seal there between. In FIG. 5, the ferrule is partly covered with a sealing material, such as elastomer. The ferrule is also covered with sealing material on the face facing the expandable metal sleeve which forms a second sealing element part 36B.

The connection ring 26 may also move on the outside of the end of the expandable metal sleeve as shown in FIG. 6. The thread of the expandable metal sleeve is an external thread, and the thread of the connection ring is an internal thread engaging the external thread when rotating the connection ring. When rotating the connection ring the inclined face 23 slides along the tapering face of the expandable metal sleeve 8 pressing the first cutting edge 25 into the outer part face 6, fastening the expandable metal sleeve 8 to the tubular metal part 7. The thread of the connection ring 26 is arranged at a distance d to the outer part face 6 forming an annular cavity 45 in which the cutting ring 21 and part of the expandable metal sleeve are arranged.

A downhole system 100 is shown in FIG. 1 comprising the annular barrier 1 forming part of the well tubular metal structure 3. The tubular metal part 7 of the annular barrier has an expansion opening 46 for letting fluid into the expandable space 9 for expanding the expandable metal sleeve. The connection ring 26 and the cutting ring 21 is made of metal. The annular barrier further comprises a valve block 47 in fluid communication with the expansion opening 46 for controlling the flow of fluid into the expandable space. The valve block may be configured to prevent fluid communication to the well tubular metal structure 3 after expansion has occurred. The valve block may furthermore be configured to, in a second position, equalise the pressure in the annulus i.e. one of the zones on one or both sides of the expanded annular barrier with the pressure in the expandable space 9 to prevent collapse of the expandable metal sleeve 8 if the outside pressure increases the pressure in the expandable space.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing or well tubular metal structure is meant any kind of pipe, tubing, tubular, liner, string etc. used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. An annular barrier for providing zonal isolation in an annulus downhole between a well tubular metal structure and another well tubular metal structure or a wall of a borehole, comprising:

a tubular metal part with an outer part face, and an expandable metal sleeve surrounding the tubular metal part forming an expandable space there between, the expandable metal sleeve is configured to be expanded in a well downhole from a first outer diameter to a second outer diameter to abut against the well tubular metal structure or the wall of the borehole, the expandable metal sleeve having a first end, a second end, an outer face, and a longitudinal extension, wherein the first end of the expandable metal sleeve has a first part of a mechanical connection, and wherein the first end of the expandable metal sleeve is connected to the tubular metal part by means of a bite connection comprising:

a cutting ring comprising an outer ring face having an inclined face and an inner ring face, having a first cutting edge configured to cut into the outer part face, and a connection ring with a second part of the mechanical connection engaging the first part of the mechanical connection of the expandable metal sleeve when the inclined face slides along a tapering face of the expandable metal sleeve for pressing the first cutting edge into the outer part face fastening the expandable metal sleeve to the tubular metal part.

2. An annular barrier according to claim 1, wherein the first part of the mechanical connection of the expandable metal sleeve is a thread, and the second part of the mechanical connection of the connection ring is a thread engaging the thread of the expandable metal sleeve forming the mechanical connection.

3. An annular barrier according to claim 2, wherein the thread of the expandable metal sleeve is an internal thread, and the thread of the connection ring is an external thread, or the thread of the expandable metal sleeve is an external thread, and the thread of the connection ring is an internal thread.

4. An annular barrier according to claim 1, wherein the first part of the mechanical connection of the expandable metal sleeve is an indentation, and the second part of the mechanical connection of the connection ring is a projectable element engaging the indentation of the expandable metal sleeve.

5. An annular barrier according to claim 1, wherein the cutting ring has a second inclined face abutting a second tapering face of the connection ring.

6. An annular barrier according to claim 1, wherein the bite connection further comprises a ferrule arranged between the cutting ring and the expandable metal sleeve or the connection ring.

7. An annular barrier according to claim 1, wherein the bite connection further comprises at least one sealing element for sealing between the expandable metal sleeve and the tubular metal part.

8. An annular barrier according to claim 1, wherein the connection ring has a first end abutting the cutting ring and a second end having an engagement element for engagement with a mounting tool in order to rotate the connection ring moving axially to force the cutting ring into engagement with the tubular metal part.

9. An annular barrier according to claim 1, wherein the first part of the mechanical connection of the expandable metal sleeve is arranged at a distance to the outer part face, forming an annular cavity in which the cutting ring and part of the connection ring are arranged.

10. An annular barrier according to claim 1, wherein the second part of the mechanical connection of the connection ring is arranged at a distance to the outer part face forming an annular cavity in which the cutting ring and part of the connection ring are arranged.

11. An annular barrier according to claim 1, wherein each end of the expandable metal sleeve is connected to the tubular metal part by means of the bite connection.

12. An annular barrier according to claim 1, wherein the cutting ring has a first end part facing the connection ring and a second end part facing the expandable metal sleeve, the second end part having a decreased thickness in relation to the first end part.

13. An annular barrier according to claim 1, wherein the tubular metal part has an expansion opening for allowing fluid into the space for expanding the expandable metal sleeve.

14. An annular barrier according to claim 1, further comprising a valve block in fluid communication with the expansion opening for controlling the flow of fluid into the space.

15. A downhole system comprising the annular barrier and the well tubular metal structure according to claim 1, wherein the annular barrier is formed as part of the well tubular metal structure.

16. An annular barrier for providing zonal isolation in an annulus downhole between a well tubular metal structure and another well tubular metal structure or a wall of a borehole, comprising:

a tubular metal part with an outer part face, and an expandable metal sleeve surrounding the tubular metal part forming an expandable space there between, the expandable metal sleeve is configured to be expanded in a well downhole from a first outer diameter to a second outer diameter to abut against the well tubular metal structure or the wall of the borehole, the expandable metal sleeve having a first end, a second end, an outer face, and a longitudinal extension, wherein the first end of the expandable metal sleeve has a first part of a mechanical connection, and wherein the first end of the expandable metal sleeve is connected to the tubular metal part by means of a bite connection comprising:

a cutting ring comprising an outer ring face having an inclined face and an inner ring face, having a first cutting edge configured to cut into the outer part face, and a connection ring with a second part of the mechanical connection engaging the first part of the mechanical connection of the expandable metal sleeve when the inclined face slides along a tapering face for pressing the first cutting edge into the outer part face fastening the expandable metal sleeve to the tubular metal part, wherein the bite connection further comprises a ferrule arranged between the cutting ring and the expandable metal sleeve or the connection ring, and wherein the tapering face is arranged on the expandable metal sleeve or is arranged on the ferrule.

17. An annular barrier according to claim 16, wherein the tapering face is arranged on the expandable metal sleeve.

18. An annular barrier according to claim 16, wherein the tapering face is arranged on the ferrule.

* * * * *